US005318469A

United States Patent [19]

Unalp et al.

[11] Patent Number: 5,318,469

[45] Date of Patent: Jun. 7, 1994

[54] DOLL HAVING CONCEALED STICKER DISPENSERS

[75] Inventors: Janet L. Unalp, Redondo Beach; William J. Kelley, Torrance, both of Calif.

[73] Assignee: Mattel, Inc., El Segundo, Calif.

[21] Appl. No.: 930,643

[22] Filed: Aug. 17, 1992

[51] Int. Cl.[5] ..... A63H 3/00

[52] U.S. Cl. ..... 446/73; 446/475; 446/901; 446/268; 221/24

[58] Field of Search ..... 446/72, 73, 71, 147, 446/268, 302, 369, 901, 390, 475; 221/24, 185, 199, 231

[56] References Cited

U.S. PATENT DOCUMENTS

| | | | |
|---|---|---|---|
| 714,553 | 11/1902 | Armstrong | 221/24 |
| 742,063 | 10/1903 | Pulver | 221/24 |
| 1,118,707 | 11/1914 | Wakefield | 446/73 |
| 1,859,635 | 5/1932 | Rose | 221/24 |
| 3,189,216 | 6/1965 | Pinard | 221/24 |
| 3,479,101 | 11/1969 | Poor et al. . | |
| 3,830,012 | 8/1974 | Franke | 446/302 |
| 3,867,785 | 2/1975 | Ryan et al. | 446/302 |
| 4,017,905 | 4/1977 | Convertine et al. | 446/302 |
| 4,311,251 | 1/1982 | Sternberg | 221/24 |
| 4,499,678 | 2/1985 | Moreau . | |
| 4,509,280 | 4/1985 | Smith | 446/72 |
| 4,561,184 | 12/1985 | Fujitan | 446/390 |
| 4,655,726 | 4/1987 | Brezezinski et al. . | |
| 4,714,275 | 12/1987 | Engel et al. | 446/901 |
| 4,782,950 | 11/1988 | Santoro | 446/73 |
| 4,889,512 | 12/1989 | Burnett et al. | 446/72 |
| 4,904,988 | 2/1990 | Nesbit et al. | 446/71 |
| 4,978,030 | 12/1990 | Morris et al. . | |
| 5,037,347 | 8/1991 | Ruscher . | |
| 5,044,959 | 9/1991 | Shaver et al. . | |
| 5,059,149 | 10/1991 | Stone . | |
| 5,094,621 | 3/1992 | Friedel | 446/73 |

*Primary Examiner*—Mickey Yu

*Attorney, Agent, or Firm*—Roy A. Ekstrand

[57] ABSTRACT

A doll includes a hollow torso supporting a head, arm appendages and foot appendages. A pair of shoes are received upon the doll's feet and support a slidable drawer having an ink pad disposed therein and a stamp roller. A pendent is secured to the doll's neck by a chain and defines an interior cavity and hingeable cover. The pendent receives a plurality of paper tags in an accordion folded configuration. An earring is removably coupled to the doll's ear and includes a stamp and covering cap in removable attachment thereto. A sticker dispenser is supported within the doll torso and is operatively coupled to one of the doll's arms such that pivotal motion of the doll's arm dispenses a sticker from a supply of stickers retained within the dispenser. A slot is provided on the frontal portion of the doll torso through which the dispenser dispenses the stickers.

13 Claims, 3 Drawing Sheets

DOLL HAVING CONCEALED STICKER DISPENSERS

FIELD OF THE INVENTION

This invention relates generally to dolls and toy figures and particularly to those having associated printed matter or the like.

BACKGROUND OF THE INVENTION

Dolls and toy figures have, through the years, enjoyed substantial popularity among children of broad age range and interest. To add interest to such dolls and toy figures beyond their appearance, practitioners in the art have endeavored to provide dolls and toy figures which participate in a variety of activities including walking, talking, eating, sleeping and other similar actions.

Certain dolls and toy figures have been associated with additional material such as messages, treats or other items which are housed within or worn upon the doll or toy figure. For example, U.S. Pat. No. 4,499,678 issued to Moreau sets forth a MECHANICAL DEVICE FOR CONCEALING OR DISPLAYING PRINTED MATTER having a doll with a removable head portion. The head portion includes a ribbon or scroll roll-up mechanism and supply. The outer end of the ribbon or scroll is secured to the neck portion of the toy figure. As a result, the head may be removed and drawn from the remainder of the figure causing the scroll or ribbon to be unwound displaying a message printed thereon. In an alternate embodiment, a heart-shaped article is similarly configured.

U.S. Pat. No. 4,655,726 issued to Brzezinski, et al. sets forth a TOY DOLL FIGURE FOR DISPLAYING COLORS having an opening formed in the doll torso. The torso opening is covered with a hinged flap member. Disposed inside the torso is a drum member supported within the housing. The drum member is covered with colored strip members which may be moved into position covering the torso opening and altering the displayed color of the toy figure.

U.S. Pat. No. 5,037,347 issued to Ruchser sets forth a WATCHING BIRD NOVELTY ITEM which includes a bird cage having a base housing and upper cage portion within which a simulated bird figure is disposed. A message dispenser is supported within the housing and conveys selected messages for children. In the embodiment shown, the bird and messages are intended to appear as messages from Santa Claus for young children.

U.S. Pat. No. 3,479,101 issued to Poor, et al. sets forth an AUTOMATIC DISPENSER having a coffin-like housing supporting a hingeable upper lid which opens to expose a simulated human corpse having a plurality of cigarettes or the like in the grasp of one hand. Operative means are supported within the simulated coffin which respond to the coffin opening to raise the figure to a seated position with the arm and clutched cigarettes extending toward the observer.

U.S. Pat. No. 4,978,030 issued to Morris, et al. sets forth CANDY DISPENSER configured to appear as a fowl or the like and having a candy container therein. In its preferred form, the candy pieces are egg-shaped and are dispensed by squeezing the container causing an egg to be ejected from an orifice on the bottom of the container with accompanying air driven sound using a reed sound making device.

U.S. Pat. No. 5,059,149 issued to Stone sets forth a STUFFED ANIMAL WITH BOOK ENCLOSURE APPARATUS having a plush body configured in a fanciful animal shape. A book receiving compartment is formed in the animal torso and is covered by a removable covering flap. Means are provided for pageably securing a book within the animal torso.

U.S. Pat. No. 5,044,959 issued to Shaver, et al. sets forth a METHOD FOR DIAGNOSING AND TREATING PSYCHOLOGICAL TRAUMA having a toy figure such as a fanciful animal which includes a torso receptacle. In response to questions, the child selects a plurality of objects which are representative of either the nature or intensity of emotional feelings in the response and inserts them into a slot receptacle in which they may be observed by the practitioner treating the child. Objects are formed as coin-like disks having various symbols such as happy smiles or sad frowns as well as mood indicating colors formed on the faces thereof.

While the foregoing described prior art devices have increased the interest value of certain dolls and toy figures and, in some case provided increased utility, there remains a continuing need in the art for evermore interesting amusing and useful dolls and toy figures.

SUMMARY OF THE INVENTION

Accordingly, it is a general object of the present invention to provide an improved doll or toy figure. It is a more particular object of the present invention to provide an improved doll or toy figure which cooperates interactively with a plurality of stamps and stickers to heighten the user's amusement and entertainment.

In accordance with the present invention, there is provided a doll for use in combination with a plurality of planar sheets, said doll comprises: a doll body having a torso defining a torso cavity and a plurality of appendages; a sheet dispenser supported within the torso cavity having means for receiving and dispensing the planar sheets; and operative means coupled to one of the appendages and the dispensing means for causing the dispensing means to dispense one of the sheets in response to the one appendage motion.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
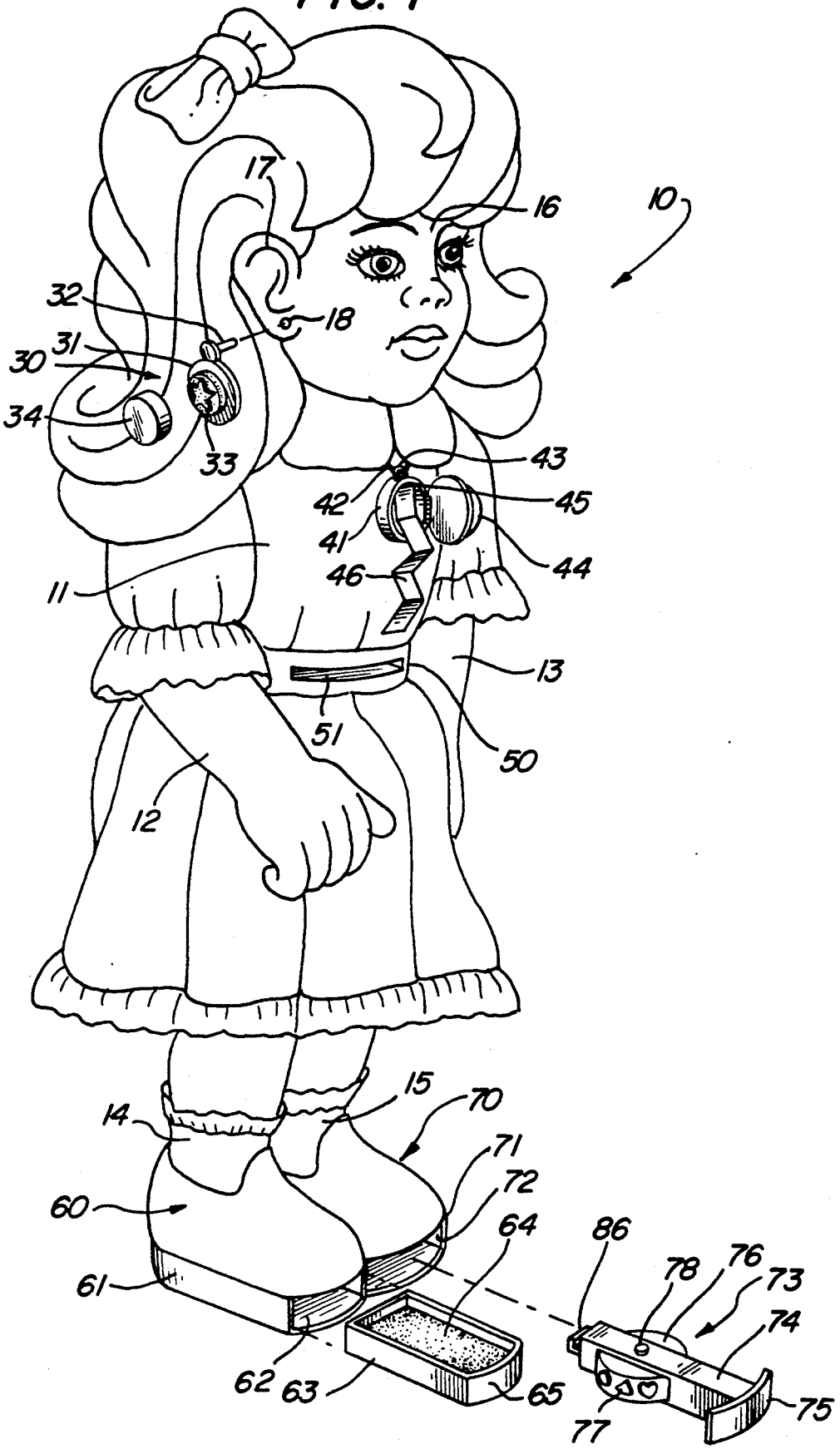
FIG. 1 sets forth a perspective view of a doll constructed in accordance with the present invention.

FIG. 1 sets forth a perspective view of a doll constructed in accordance with the present invention and generally referenced by numeral 10. Doll 10 includes a torso 11, a head 16, a right arm 12, a left arm 13, a right foot 14 and a left foot 15. Head 16 is formed to replicate a young human child and includes an ear 17 having a aperture 18 formed in the earlobe thereof. As is set forth below in greater detail, right arm 12 and left arm 13 are pivotally coupled to torso 11. As is also set forth below in greater detail, left arm 13 is coupled to a sticker dispensing mechanism. An earring 30 includes a generally disk-shaped base 31 having an attachment post 32 secured thereto. Post 32 is receivable within aperture 18 to provide a removable attachment for earring 30 to ear 17. Earring 30 further includes a resilient embossed stamp 33 supported upon base 31 and a closure cap 34 which is removably securable to embossed stamp 33 and base 31.

Doll 10 further includes a pendent 40 having a base 41 and an eyelet 43. A chain 42 is received within eyelet 43 and encircles the neck portion of torso 11 to support pendent 40. Pendent 40 further defines an interior cavity 45 within which a plurality of folded tear off paper tags 46 are supported in an accordion fold-like stack. Pendent 40 also includes a hinged cover 44 which in the closed position conceals interior cavity 45 and tear off paper tags 46. In the open position, hinged cover 44 pivots outwardly and away from base 41 exposing interior cavity 45 and paper tags 46.

Doll 10 further includes a waste belt 50 defining a slot 51 therein. As is set forth below in greater detail, slot 51 extends through base 50 and torso 11 to provide access to the interior of torso 11.

Doll 10 further includes a right shoe 60 received upon right foot 14 and including a bottom housing 61 having a cavity 62 formed therein. A generally rectangular drawer 63 supports an ink pad 64 and is receivable within cavity 62 in a sliding engagement. As is better seen in FIG. 6, drawer 63 is securable within cavity 62 by a releasible lock mechanism. Drawer 63 receives and supports an ink pad 64 and defines a curved front 65. Curved front 65 is intended to provide a normal frontal portion for housing 61 and preferably blends in with the structure of right shoe 60 to conceal the presence of drawer 63.

Doll 10 further includes a left shoe 70 received upon left foot 15 and defining a lower housing 71. Housing 71 defines a generally rectangular cavity 72. A stamp roller 73 includes an elongated generally support shaft 74 having a generally cylindrical roller 76 rotatably supported thereon by a pin 78. Roller 76 is preferably formed of a resilient material such as rubber or the like and defines a plurality of raised elements 77 on the outer surface thereof. Stamp roller 73 further includes a curved handle 75. Stamp roller 73 is receivable into and storable within cavity 72 of left shoe 70 in a sliding attachment. By means set forth below in FIG. 5, stamp roller 73 is removably securable within cavity 72 by a releasible lock mechanism. Curved handle 75 is preferably formed to blend with the outer contour of left shoe 70 and thus conceal the presence of stamp roller 73.

In operation, and by means set forth below in greater detail, doll 10 is operative in response to pivotal motion of arm 13 to dispense one or more adhesive backed paper stickers through slot 51 at belt 50. As is better seen in FIG. 4, a sticker dispensing mechanism within torso 11 is operative to retain a supply of adhesively backed stickers which are dispensed in a novel manner through slot 51 In further accordance with the anticipated play pattern, the child user may remove earring 30 from ear 17 and utilize embossed stamp 33 therein after removing cap 34 to provide coded stamping or personalized marking and stamping of paper objects such as the dispensed stickers. In its preferred form, embossed stamp 33 comprises the so-called "self-inking" type stamps in which a supply of ink is supporting within cap 34 in accordance with conventional fabrication techniques.

Further variety of play pattern is provided by pendent 40 which supports a plurality of tear off paper tags which may be either plain paper tags or stickers having adhesive backing thereon. Tags 46 may be utilized to provide stamped messages using embossed stamp 33 or, alternatively, may be handwritten messages or otherwise stamped or marked.

In the preferred form of the present invention, doll 10 further includes an additional earring stamp identical in construction to earring 30 and supported upon the remaining ear (not shown) of doll 10 in the manner shown for earring 30.

Drawer 63 is, as described above, removable from cavity 62 of right shoe 60 and may be utilized as a inking pad for additional stamps for use in combination with the present invention doll. Stamp roller 73 is, as described above, removable from housing 71 of left shoe 70 and provides a roller stamping device which may be inked by use of ink pad 64 to provide a series of stamped marks or image elements upon tear off paper tags 46 or additional paper.

Thus, doll 10 provides a conventional outer appearance within which a plurality of stamped elements and inking pads are concealed but nonetheless available for use and thereafter returnable to convenient concealed storage. In addition, in the manner set forth below in greater detail, doll 10 provides a novel sticker dispensing mechanism which cooperates with the movements of doll 10 to dispense one or more stickers through a slot formed in the front torso of the doll. Finally, a pendent secured about the doll's neck and conventional in appearance provides convenient storage in a concealed fashion for a plurality of tear off folded paper tags to further enhance the play value of doll 10. It should be noted that none of the above-described novel paper and stamp features of doll 10 detract from the otherwise conventional appearance of doll 10 or its usefulness in a conventional play pattern not utilizing the present invention but making use of the doll in a conventional childrens' play pattern.

It should also be noted that in the embodiment shown in FIGS. 1 through 6, doll 10 is formed to resemble a young female child of more or less conventional doll appearance. It should also be noted that the present invention doll may be fabricated in a variety of outer appearances and configurations in accordance with doll or toy figure appearance preferences. Thus, while the present invention may be referred to frequently as either a "doll" or "toy figure" or "figure" in the descriptions and in the claims of the present application, it should be understood that these terms as they relate to the present invention and its practice are generally synonymous and interchangeable.

Figure 2:
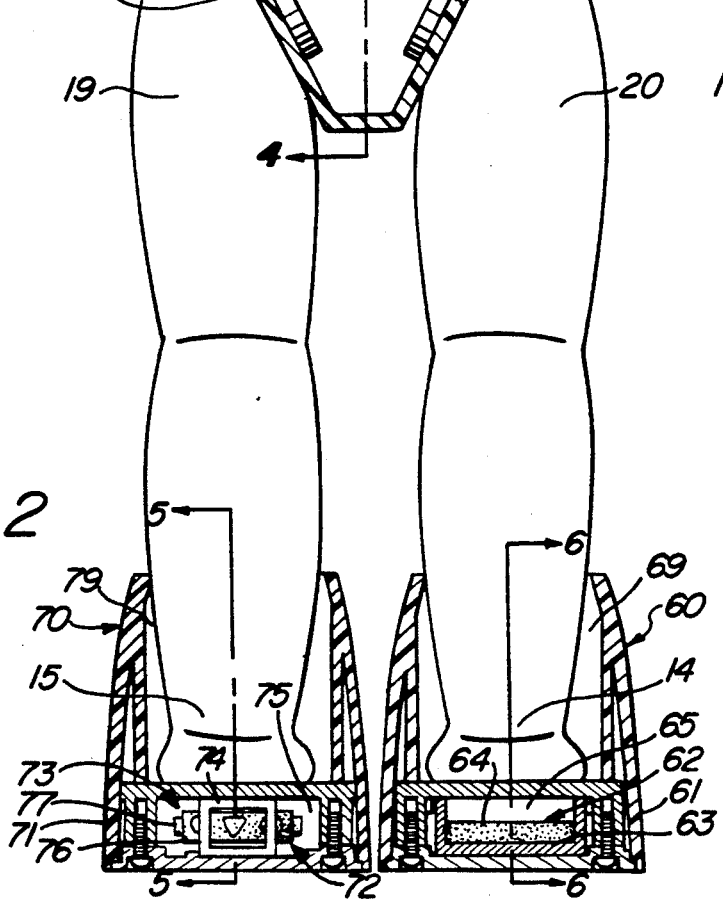
FIG. 2 sets forth a partially sectioned rear view of the present invention doll.

FIG. 2 sets forth a partially sectioned rear view of the present invention doll showing the torso, sticker dispensing mechanism, together with right and left shoes in section view. More specifically, doll 10 includes a torso 11 having an interior cavity 90 formed therein. Head 16 is secured to torso 11 in accordance with conventional fabrication techniques as are legs 19 and 20. Torso 11 further defines a pair of generally planar support members 103 and 104 secured to the inner surfaces of torso 11 in accordance with conventional fabrication techniques. Torso 11 further defines an aperture 93 at the shoulder location of torso 11. In accordance with the present invention, left arm 13 includes a shoulder joint element 91 having a generally circular groove 92 formed therein. Groove 92 receives the portion of torso 11 surrounding aperture 19 to pivotally secure left arm 13 to torso 11.

A dispensing frame 110 is secured to the interior of torso 11 by a pair of conventional fasteners 121 and 122. Dispensing frame 110 is received between supports 103 and 104 and securely fixed by fasteners 121 and 122. Dispenser 110 further defines a supply chamber 111 having a downwardly extending generally cylindrical boss members 117 and 118 in the upper portion thereof. A movable compactor element 112 is slidably supported and vertically movable within supply chamber 111. Compactor 112 further includes a pair of upwardly extending generally cylindrical spring guides 113 and 114 generally aligned with bosses 117 and 118 respectively. A pair of coil springs 115 and 116 are received upon spring guides 113 and 114 respectively and downwardly extending bosses 117 and 118 respectively. Coil springs 115 and 116 are compression springs and provide a downward force urging compactor 112 downwardly.

A plurality of adhesive paper stickers 120, preferably having peel-off backing portions, are stacked within supply chamber 111 beneath compactor 112. Thus, springs 115 and 116 cooperate with compactor 112 to provide a downward force upon stickers 120.

Arm 113 further includes a gear support 95 secured to shoulder joint member 91 by an attachment pin 94. Gear support 95 further includes a downwardly extending gear segment 96. A gear 100 is supported upon support 104 by a pin 97 and engages gear segment 96 in the manner better seen in FIG. 3. A roller 102 is rotatably supported within apertures 98 and 99 of supports 104 and 103 respectively. A roller gear 101 is secured to roller 102 and rotatable therewith. Roller 102 is positioned to provide engagement between roller gear 101 and gear 100 in a relationship better seen in FIG. 3. Roller 102 further defines a generally cylindrical outer gripping surface 105 preferably formed of a resilient foam plastic or rubber material suitable for frictionally engaging stickers 120 in the manner described below in greater detail.

Right shoe 60 defines a shoe interior 69 which receives right foot 14 in a generally conventional attachment. As described above, right shoe 60 defines a lower housing 61 having an interior cavity 62 formed therein. As is also described above, a drawer 63 is slidably received within cavity 62 and includes a curved front 65 and supports an ink pad 64.

Left shoe 70 defines a shoe interior 79 which receives left foot 15 in a conventional attachment. As is also described, left shoe 70 defines a lower housing 71 having a cavity 72 formed therein. A stamp roller 73 includes a support shaft 74, a rotatable roller 76 having a plurality of extending embossing elements 77 formed thereon. Stamp roller 73 further includes a curved handle 75 and, as described above, is removably received within interior cavity 72.

In operation, the pivotal motion of left arm 73 causes a corresponding rotation of shoulder joint element 91 within aperture 93 of torso 11. This rotational motion is imparted to gear support 95 and gear segment 96. The engagement of gear segment 96 with 100 produces a corresponding rotation of gear 100 which in turn produces rotation of roller gear 101 rotating roller 102. Because gripping surface 105 of roller 102 is in contact with the bottommost one of stickers 120, the rotation of roller 102 frictionally engages the bottommost one of stickers 120 and forces it outwardly through slot 51 of torso 11 in the manner better seen in FIG. 4. During the sticker dispensing rotation of roller 102, compactor 112 and springs 115 and 116 maintain a sufficient force upon stickers 120 against gripping surface 105 of roller 102 to ensure that rotation of roller 102 provides the desired dispensing motion of the bottommost sticker within stickers 120.

Figure 3:
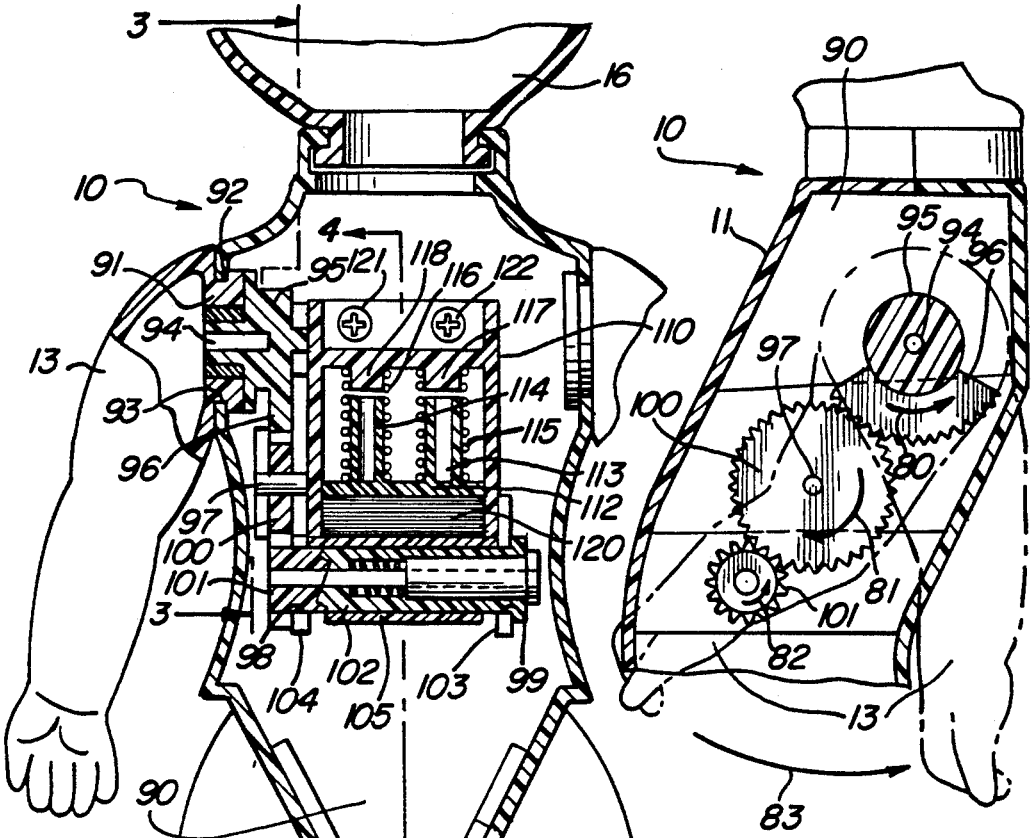
FIG. 3 sets forth a partial section view of the present invention doll taken along section lines 3—3 in FIG. 2.

FIG. 3 sets forth a partial section view of doll 10 taken along section lines 3—3 in FIG. 2. As described above, torso 11 defines an interior cavity 90. As is also described above, arm 13 is pivotally secured to torso 11 and supports a gear support 95 having a downwardly extending gear segment 96 both rotatably supported by a pin 94. A gear 100 is pivotally supported within torso 11 by pin 97 and is in operative engagement with gear segment 96. Finally, roller gear 101 is supported by roller 102 (seen in FIG. 2) and is in operative engagement with gear 100.

In operation, the sticker dispensing process is initiated by moving arm 13 to the forwardmost pivotal position shown in dashed line representation in FIG. 3. Thereafter, the dispensing of the next sticker within the stack of stickers 120 (seen in FIG. 2) is achieved by pivoting arm 13 to the rearward position shown in dashed line representation in FIG. 3 and represented by directional arrow 83. The pivotal motion of arm 13 in the direction indicated by arrow 83 produces a corresponding rotational motion of gear segment 96 in the direction indicated by arrow 80. Gear 100 is correspondingly rotated in the direction indicated by arrow 81 which in turn causes roller gear 101 (and roller 102) seen in FIG. 2 to rotate in the direction indicated by arrow 82 which, as is better seen in FIG. 4, dispenses the bottommost sticker from the quantity of stickers 120 supported within dispenser frame 110 (seen in FIG. 2).

This dispensing process may be repeated by again pivoting arm 113 forwardly to the forwardmost dashed line position shown in FIG. 3 afterwhich the rearward stroke in the direction of arrow 83 produces the above-described rotations of gear segment 96, gear 100 and roller gear 101 to dispense the next sticker.

Figure 4:
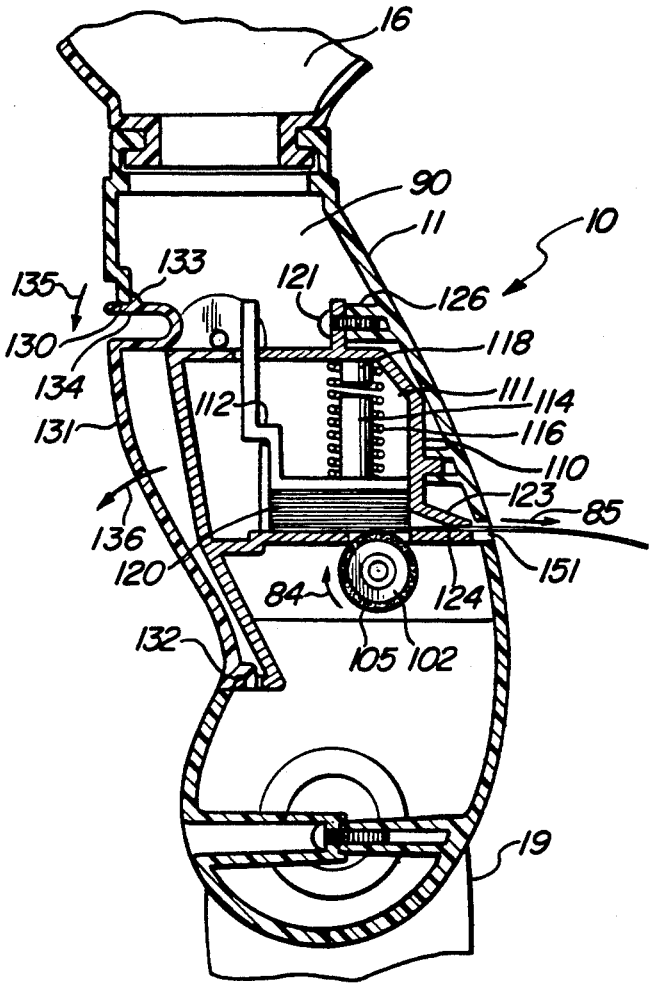
FIG. 4 sets forth a partial section view of the present invention doll taken along section lines 4—4 in FIG. 2.

FIG. 4 sets forth a partial section view of doll 10 taken along section lines 4—4 in FIG. 2. Doll 10 includes a torso 11 defining an interior cavity 90 and supporting a head 16 and a leg 19 in a conventional attachment. A dispenser frame 110 is received within cavity 90 of torso 11 and secured therein by conventional attachment means including a boss 126 and a fastener 121. Dispenser frame 110 defines a supply chamber 111 within which a compactor 112 is received. Compactor 112 is vertically movable within supply chamber 111 and overlies and rests upon a quantity of stickers 120. Dispenser frame 110 further includes a downwardly extending boss 118 which receives one end of a spring 116. Compactor 112 further includes an upwardly extending generally cylindrical spring guide 114 positioned in general alignment with boss 118 and receiving the remainder of spring 116. Spring 116 is a coil spring captivated by boss 118 and spring guide 114 and maintained in a compressed condition. Thus, spring 116 exerts a downward force upon compactor 112 which in turn force stickers 120 downwardly. Dispenser frame 110 further includes an elongated slot 125 and an angularly disposed sticker guide 123. Sticker guide 123 and the bottom surface of dispenser frame 110 define a laterally extending space 124 generally aligned with slot 51 of torso 11.

A roller 102 includes an outer resilient gripping surface 105 and in the manner described above is rotationally supported beneath dispenser frame 110. Roller 102 is positioned with respect to slot 125 such that gripping surface 105 thereof extends upwardly through slot 25 and contacts the bottommost sticker within stickers 120. Thus, the downward force upon stickers 120 provided by spring 116 and compactor 112 forces the bottommost sticker against gripping surface 105 of roller 102.

Torso 11 further defines a rear opening 130 within which a door 131 is hingeably secured by a pivotal hinge attachment 132. Door 131 further defines a U-shaped spring lock 134 having an upwardly extending snap tab 133 formed therein. Door 131 is normally closed during the operation of doll 10 but is opened to renew the supply of stickers 120 within dispenser frame 110. Door 131 is opened by flexing spring lock 134 downwardly in the direction indicated by arrow 135 releasing spring tab 133 from opening 130 of torso 11. Thereafter, door 131 is pivoted in the direction indicated by arrow 136 and may be removed by withdrawing door 131 from hingeable attachment 132. Once the supply of stickers 120 is renewed, door 131 may be restored using the reversal of the above-described procedure.

In operation, the movement of arm 13 (seen in FIG. 3) provides the above-described rotational motion of roller 102. Thus, as roller 102 is rotated in the direction indicated by arrow 84 using the above-described motion of arm 13, the friction created between gripping surface 105 and the bottommost one of stickers 120 drives the bottommost sticker outwardly through space 124 and slot 51 in the direction indicated by arrow 85. This process may be continued with successive strokes of arm 13 (seen in FIG. 3) until the supply of stickers 120 is exhausted.

Figure 5:
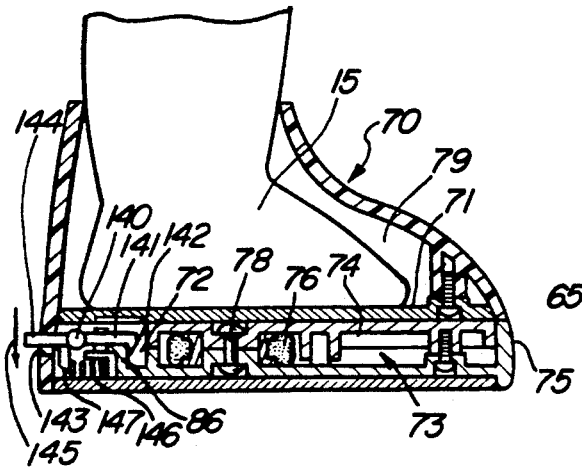
FIG. 5 sets forth a partial section view of the present invention doll taken along section lines 5—5 in FIG. 2.

FIG. 5 sets forth a section view of left shoe 70 taken along section lines 5—5 in FIG. 2. As described above, left shoe 70 defines a shoe interior 79 receiving left foot 15 in a conventional attachment. Shoe 70 further includes a lower housing 71 defining an interior cavity 72 therein. A lock lever 141 is pivotally secured within cavity 72 by a pin 140. Lever 141 defines a downwardly extending lip 142 and a downwardly extending spring tab 147. End portion 144 of lock lever 141 extends outwardly from cavity 72 through an aperture 143 formed in the rear portion of housing 71. A coil spring 146 is captivated within cavity 72 and exerts a spring force against spring tab 147 urging lock lever 141 in the direction of clockwise rotation about pin 140.

Stamp roller 73 includes an elongated shaft 74 supporting a roller 76 and a pin 78. Shaft 74 further includes a rearwardly extending lock tab 86.

With stamp roller 73 inserted fully into cavity 72 of housing 71 in the position shown in FIG. 5, lock lever 141 having downwardly extending lip 142 engages lock tab 86 which captivates stamp roller 73 within cavity 72. The spring force of spring 146 is selected to provide sufficient spring bias to maintain the position shown in FIG. 5 for lock lever 141. In the event, however, the user desires to use stamp roller 73 and withdraw it from cavity 72, a downward force upon end 144 of lock lever 141 in the direction indicated by arrow 145 pivots lock lever 141 counterclockwise about pin 140 withdrawing lip 142 from engagement with lock tab 86. With lip 42 out of engagement with lock tab 86, stamp roller 73 may be freely withdrawn from cavity 72. Stamp roller 73 may be returned to interior cavity 72 by a simple sliding insertion forcing lock tab 86 against lip 142 of lever 141 overcoming the force of spring 146 and permitting stamp roller 73 to be fully seated within cavity 72 and locked therein by the spring-biased attachment of lock lever 141.

Figure 6:
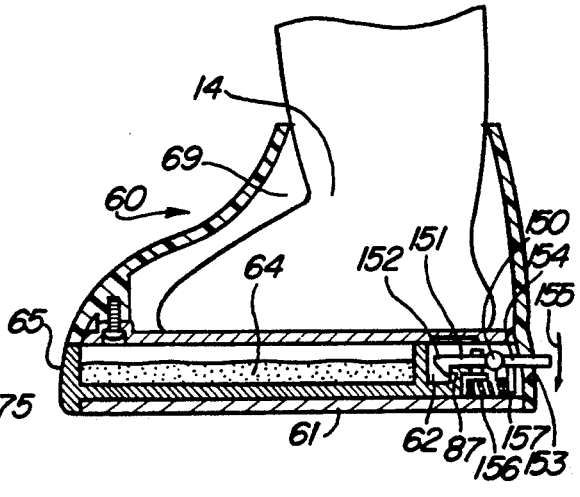
FIG. 6 sets forth a partial section view of the present invention doll taken along section lines 6—6 in FIG. 2.

FIG. 6 sets forth a partial section view of right shoe 60 taken along section lines 6—6 in FIG. 2. Right shoe 60 defines a shoe interior 69 receiving right foot 14. Shoe 60 further includes a lower housing 61 having an interior cavity 62 formed therein. A drawer 63 is slidably received within cavity 62 and supports an ink pad 64. Drawer 63 further includes a curved front 65 and an upwardly extending lock tab 87. Shoe 60 further includes a locking mechanism which is substantially identical to the locking mechanism provided for shoe 70 and described above. Thus, a lock lever 151 defines a lip 152 and an outwardly extending end 154 and is pivotally secured within interior cavity 62 by a pin 150. Housing 61 defines an aperture 153 which receives end 154 of lever 151. Lever 151 further includes a downwardly extending spring tab 157 which captivates a coil spring 156. Coil spring 156 urges lock lever 151 in the counterclockwise direction causing lip 152 to engage and captivate lock tab 87 of drawer 63. In the position shown in FIG. 6, lip 152 and lock lever 151 engage lock tab 87 and captivate drawer 63 within interior cavity 62. Drawer 63 may be withdrawn from interior cavity 62 by pressing end 154 downwardly in the direction indicated by arrow 155. The downward motion of end 154 pivots lock lever 151 in the clockwise direction releasing lip 52 from engagement with lock tab 87 and disengaging drawer 63 permitting its withdrawal from housing 61. Drawer 63 may be returned to the secured position shown in FIG. 6 by forcing drawer 63 into cavity 62 such that lock tab 87 forces lip 152 of lock lever 151 upwardly in a snap-fitting engagement.

What has been shown is a novel doll having a concealed sticker dispenser and a plurality of concealed cooperating stamp elements and a paper supply to provide enhanced play value for an otherwise normal appearing doll. The doll shown supports and stores a stamp roller and inking pad within the shoe portions of the doll while providing a paper supply within a cooperating pendent and an additional stamp within a removable earring. A supply of adhesive backed peel-off stickers is supported within a dispenser mechanism inside the doll's hollow torso. A dispensing mechanism is operatively coupled between one of the doll's arms and the supply of stickers to facilitate the dispensing of the stickers through a slot provided on the frontal portion of the doll torso. An access door at the rear of the doll torso permits the replenishment of the sticker supply within the doll.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll for use in combination with a plurality of planar sheets, said doll comprising:

a doll body having a torso defining a torso cavity, a pair of arms and a pair of legs and feet;

a sheet dispenser supported within said torso cavity having means for receiving said plurality of planar sheets and for dispensing said planar sheets;

operative means coupled to one of said arms and said dispensing means for causing said dispensing means to serially dispense said planar sheets from said plurality of planar sheets in response to said arm motion outwardly from said torso to emerge in a visible position;

a first shoe having a removably secured ink pad disposed therein; and a second shoe having a removably secured stamp disposed therein.

2. A doll as set forth in claim 1 wherein said torso defines a dispensing aperture and wherein said planar sheets are dispensed through said dispensing aperture.

3. A doll as set forth in claim 2 wherein said one of said arms is pivotally secured to said torso.

4. A doll as set forth in claim 3 further including a plurality of planar said planar sheets include stickers having an adhesive bearing side.

5. A doll as set forth in claim 4 wherein said torso defines an access door movable to an open position exposing said dispensing means.

6. A doll as set forth in claim 5 wherein said removably secured stamp includes a roller stamp having a rotatable embossed stamp roller.

7. A doll as set forth in claim 6 further including an earring removably attachable to said doll and having a base, an embossed stamp element and a covering cap.

8. A doll as set forth in claim 6 further including a pendent secured to said doll and having a base supporting a quantity of paper and a hingeable cover for either covering or exposing said paper.

9. A doll comprising:

a doll body defining an interior cavity therein, a dispensing aperture, a pair of arms, a pair of legs and a pair of feet;

a supply of to-be-dispensed generally planar elements;

dispensing means supported with said interior cavity for supporting said to-be-dispensed generally planar elements and dispensing them through said dispensing aperture;

operative means coupled to said dispensing means for initiating dispensing action thereof to cause said to-be-dispensed generally planar elements to be repeatedly dispensed through said dispensing aperture in serial manner to be visible to the user;

a first shoe having a removably secured ink pad disposed therein; and a second shoe having a removably secured stamp disposed therein.

10. A doll as set forth in claim 9 wherein said to-be-dispensed elements include paper sheets and wherein said operative means include a movable doll appendage.

11. A doll as set forth in claim 10 wherein said doll body includes a torso and wherein said dispensing aperture is formed therein.

12. A doll as set forth in claim 11 wherein said appendage includes an arm pivotally secured to said torso.

13. A doll having a pair of arms, a pair of legs, a pair of feet, an interior cavity, a sheet dispenser, a plurality of generally planar sheets within said dispenser, a dispensing aperture in communication with said interior cavity and repeatedly operable operative means for causing said sheet dispenser to dispense at least one of said sheets through said dispensing aperture each time said operative means is activated; a first shoe having a removably secured ink pad disposed therein; and a second shoe having a removably secured stamp disposed therein.

* * * * *